US009302268B2

(12) United States Patent
Palladini

(10) Patent No.: US 9,302,268 B2
(45) Date of Patent: Apr. 5, 2016

(54) WEAR-RESISTANT LINING FOR MILLS

(71) Applicant: CERTECH S.P.A. a SOCIO UNICO, Sassuolo (Modena) (IT)

(72) Inventor: Alberto Palladini, Castelnovo Ne' Monti (IT)

(73) Assignee: CERTECH S.P.A. A SOCIO UNICO, Sassuolo (IT)

( * ) Notice: Subject to any disclaimer, the term of this patent is extended or adjusted under 35 U.S.C. 154(b) by 370 days.

(21) Appl. No.: 13/911,751

(22) Filed: Jun. 6, 2013

(65) Prior Publication Data

US 2013/0327863 A1 Dec. 12, 2013

(30) Foreign Application Priority Data

Jun. 11, 2012 (IT) ..... MO2012A0151

(51) Int. Cl.
*B02C 17/22* (2006.01)

(52) U.S. Cl.
CPC ..... *B02C 17/225* (2013.01)

(58) Field of Classification Search
CPC ..... B02C 17/22; B02C 17/225
USPC ..... 241/182, 183, DIG. 30
See application file for complete search history.

(56) References Cited

U.S. PATENT DOCUMENTS

| | | | | |
|---|---|---|---|---|
| 1,921,672 A * | 8/1933 | Haushalter | B02C 17/225 241/183 |
| 2,210,357 A * | 8/1940 | Beament | 428/614 |
| 5,814,273 A | 9/1998 | Nielsen | |

FOREIGN PATENT DOCUMENTS

| | | | |
|---|---|---|---|
| DE | 198 47 920 | A1 | 4/2000 |
| IT | 1287434 | B1 | 8/1998 |
| RU | 2284861 | C1 * | 10/2006 |
| RU | 110294 | U1 * | 11/2011 |
| SU | 679240 | A1 | 8/1979 |

* cited by examiner

*Primary Examiner* — Mark Rosenbaum
(74) *Attorney, Agent, or Firm* — Pearne & Gordon LLP

(57) ABSTRACT

A wear-resistant lining for ball mills comprises a base (3) made of a material that is elastically deformable at the work surface (4) subjected to wear from which it is obtained, a plurality of cavities or hollows (5) suitable for accommodating bodies of hard material inside them. The presence of said bodies of hard material has the function of imparting particular wear resistance to the work surface (4) in that they are suitable for coming into contact with the grinding bodies or balls (6) made of hard material which are used in the mill as the grinding charge. The cavities or hollows (5) of at least part of said plurality are dimensioned and proportioned so that each of them is suitable for accommodating at least one of the grinding bodies or balls (6) inside it. The cavities or hollows (5) are shaped and dimensioned in relation to the shape and size of the grinding bodies or balls (6) so that when insertion and coupling are completed, the grinding bodies or balls (6) are stably housed in the respective cavities (5).

15 Claims, 2 Drawing Sheets

Fig. 1
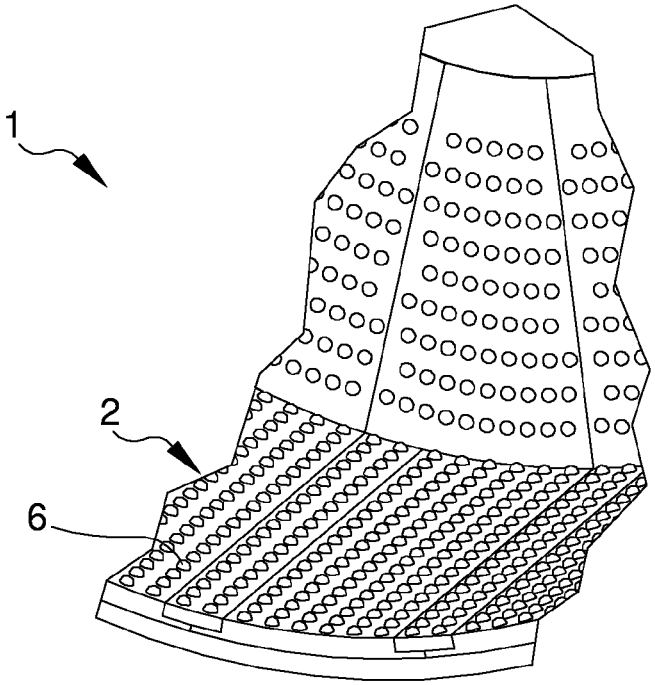
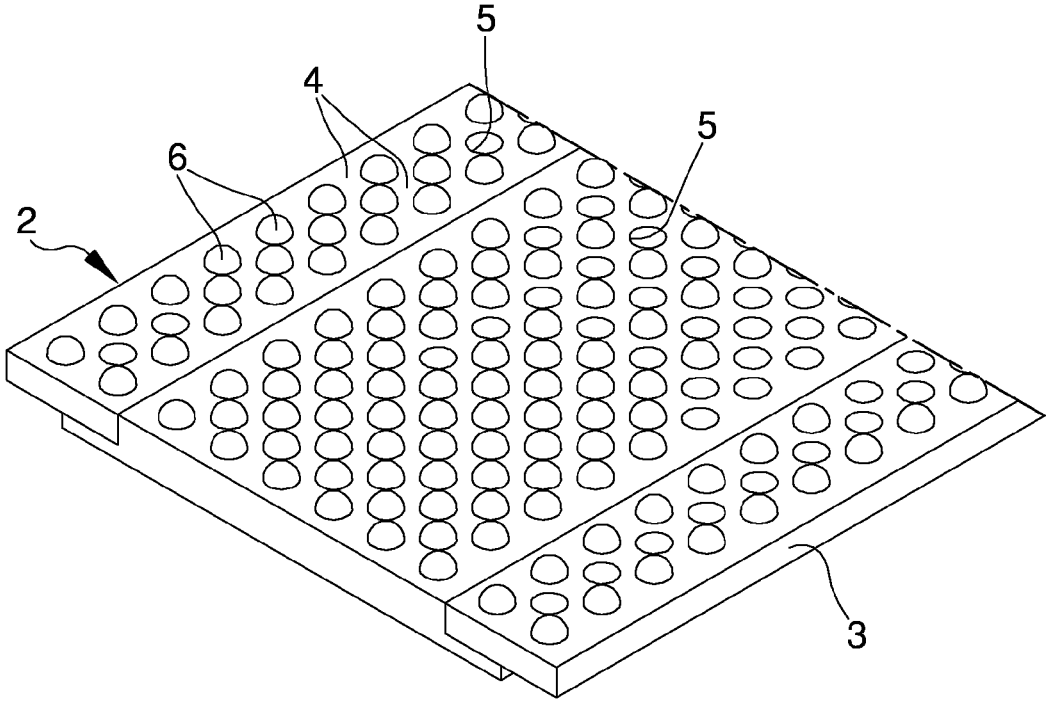
Fig. 2

WEAR-RESISTANT LINING FOR MILLS

The subject matter of the present invention is a wear-resistant lining for ball mills. The grinding balls or bodies constituting the grinding charge are made of hard materials. For example in the grinding of materials for the ceramics industry, they are frequently made of alumina. However, they may also be made of steel, steatite and even pebbles.

The mill lining may be total or partial.

Linings made of various materials are known in the prior art.

For example, there are known linings made of hard materials, for example alumina-based materials, and obtained by arranging actual bricks side by side and cemented one to the other so as to cover all of the internal walls of the mill chambers. This is actual masonry requiring very long amounts of time for assembly and reconditioning.

There are also known wear-resistant rubber linings that are realized with modular elements constituted by sheets and pieces of rubber of various dimensions. These types of executions require relatively little time for installation and offer the positive feature of enabling replacement of individual worn-out sheets or elements somewhat easily. However, the linings made of wear-resistant rubber require replacement of the entire lining, or even only part of it, with a certain frequency. In fact, there are parts of these linings that owing to the geometrical and operating characteristics of the mills are more susceptible to wear than others. Therefore, in these cases, it is necessary to stop the mill in order to proceed with replacement only of some worn-out parts of the lining and not of the entire lining.

All of this is the cause of evident inconveniences and diseconomies that have negative repercussions on the entire production cycle of which the mill is a part.

These disadvantages are more accentuated in the case of continuous mills.

There are also known wear-resistant linings such as that illustrated in the Italian patent No. 1287434, which describes a wear-resistant lining for mills that comprises a rubber base, in which plates of hard material are stably inserted, with part of the external surface thereof appearing at the surface of the lining that undergoes wear.

Although they are capable of performing their function advantageously with respect to prior linings, wear-resistant linings such as that described above, which can be realized by incorporating small bricks of wear-resistant material such as alumina in the rubber base, are not, however, without defects and drawbacks that substantially originate from the manufacturing technique, which in any case provides for the inclusion of the wear-resistant bricks in the mass of a rubber base by means of pressing and vulcanizing operations and the subsequent assembly of the various portions of the lining thus formed so as to form the complete lining.

The present invention, as defined by the claims and described, proposes to overcome the drawbacks and shortcomings of the prior art illustrated above, particularly regarding the construction of the wear-resistant lining obtained by stably incorporating the hard materials in the mass of the rubber base. The principal aim of the present invention is to overcome the said limits of the prior art, proposing the realization of a wear-resistant lining for ball mills as stated in the claims and the description.

An advantage of the invention consists in the structural capacity thereof of requiring solely the arrangement and the assembly of the base of the lining, leaving the formation of the complete lining, comprising the insertion of hard bodies or inserts in the base, to a brief initial operating step preferably carried out without a load to be ground, and only with the charge of balls or grinding bodies.

Another advantage of the invention consists in it enabling the realization of a base of the lining provided with an extremely regular distribution of cavities and composed of panels that are geometrically regular in shape and easy to transport and mount.

A further advantage is represented by less use of material and thus lower weight of the lining.

These aims and advantages, as well as others still, are all achieved by the invention at hand, as described and defined by the claims appended herein below.

Further characteristics and advantages of the present invention will become more apparent from the following detailed description of some embodiments of the invention at hand, these embodiments being illustrated by way of non-limiting example in the accompanying figures, in which:

FIG. 1 shows part of a schematic perspective overview of the invention;

FIG. 2 shows a portion of the lining appearing in FIG. 1, at an enlarged scale;

Figure 3:
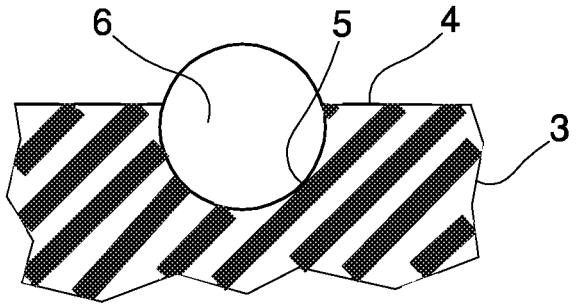
FIG. 3 shows, at an enlarged scale, part of a cross section taken along a plane normal to the work surface of the lining.
Figure 4:
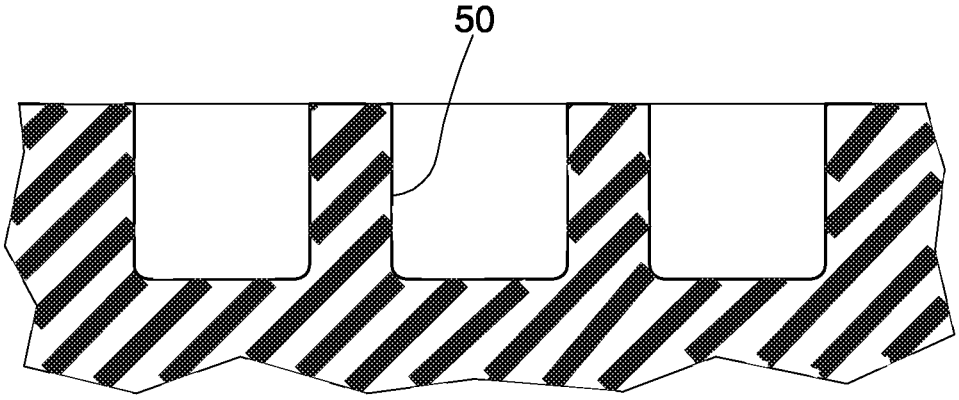
FIG. 4 shows, on the same scale as FIG. 3, part of a cross section taken along a plane normal to the work surface of the lining and relating to a different embodiment.

With reference to the figures cited, the number "1" schematically indicates a ball mill used for the fine grinding of materials utilized in the ceramics industry. The mill is constituted by a rotating drum, provided with an adequate resistant structure, the internal compartment of which is designed to comprise the grinding balls or bodies 6 together with the load of material to be ground, and has walls covered by a lining indicated in its entirety as "2". The latter proves to be made up of a base 3, which is made of a material that is elastically deformable. The most frequently used material is rubber (natural and wear-resistant), but all materials, even synthetic materials, can be used as long as they have similar characteristics as regards elastic deformability, abrasion resistance, water resistance and resistance to the main chemical agents.

A plurality of cavities or hollows 5 suitable for accommodating therein bodies of hard material, in the manner of inserts, are afforded at the work surface 4 subjected to wear, which is the surface designed to come into contact with the grinding balls or bodies 6 and with the load of material to be ground.

The insertion of these bodies of hard material serves the purpose of giving substance to a "composite" surface that is particularly resistant in that it performs the function of imparting particular wear resistance to the work surface 4.

Once inserted stably in the cavities or hollows 5, these bodies serve the function of coming into contact with the grinding bodies or balls 6 of hard material, which are still free and constitute the grinding charge (which, in the performance of the milling action, moves together with the load of materials to be ground). The hard bodies stably inserted in the cavities or hollows 5 is are thus utilized to "absorb" a good part of the overall level of wear transmitted to the lining 2 of the mill.

In the case in point, the cavities or hollows 5 of at least part of the plurality of cavities or hollows 5 arranged at the work surface 4 are dimensioned and proportioned so that each of them is suitable for accommodating therein at least one of the grinding bodies or balls 6, which, at least initially, are part of the grinding charge in operation in the mill.

In particular, the cavities or hollows 5 are shaped and dimensioned in relation to the shape and size of the grinding bodies or balls 6 so that upon completion of the insertion and coupling of a pre-established part of the grinding bodies or balls 6 in the respective cavities or hollows 5, there is defined an operative configuration distinguished by the fact that said grinding bodies or balls 6 are stably housed in the respective cavities 5.

According to a first embodiment, at least one portion of each grinding body or ball 6 stably housed in the respective cavity 5 protrudes externally at least in part from said work surface 4.

In another embodiment, the cavities 5 are shaped and dimensioned in relation to the shape and size of the grinding bodies or inserts 6 so that when insertion and coupling are completed, at least a portion of each of said grinding bodies or balls 6 is situated at the same level as the work surface 3 so as not to protrude therefrom.

According to a further embodiment, the cavities 5 are shaped and dimensioned in relation to the shape and size of the grinding bodies or balls 6 so that when insertion and coupling are completed, the grinding bodies or balls 6 or part thereof are situated below the level established by the work surface 3.

In particular, according to the first embodiment illustrated, each cavity or hollow 5 appears in the form of a cavity defined by the spherical surface portion of a spherical segment whose depth is not less than the radius of the corresponding sphere or grinding body 6 that is to be housed therein.

Preferably, this depth is slightly greater than the measurement of the radius of the grinding ball or body 6. Once insertion has taken place, this enables stable locking.

These grinding bodies or balls 6, in the initial, non-worn state, preferably have mutually equal diameters. In particular, these diameters, or more in general, the sizes of the grinding bodies or balls 6, in the initial, non-worn state, are determined so as to enable a coupling by interference of a grinding body or ball 6 in a cavity or hollow 5.

In another embodiment, each cavity or hollow 5 is in the form of an essentially cylindrical cavity or hollow 50 thus delimited by a lateral cylindrical surface with an axis perpendicular to the work surface 4 and having a diameter such as to enable a coupling by interference with one grinding body or ball 6 in the initial, non-worn state.

Moreover, each cylindrical cavity or hollow 50 has a depth that is not less than the diameter of one of the grinding bodies or balls 6 in the initial, non-worn state.

This means that the transverse dimension (diameter) of the cavity is slightly smaller than the diameter of the grinding ball or body 6 and that the depth thereof is smaller by a pre-established amount so as to enable the grinding ball or body to protrude from the work surface 4.

Further embodiments comprise the use of bases 3 having cavities of different shapes, suitable for accommodating grinding bodies of different shapes and sizes.

In particular, the lining may be made up of a base 3 having cavities of different shapes and sizes, suitable for accommodating a number of grinding bodies packed tightly side by side.

Figure 5:
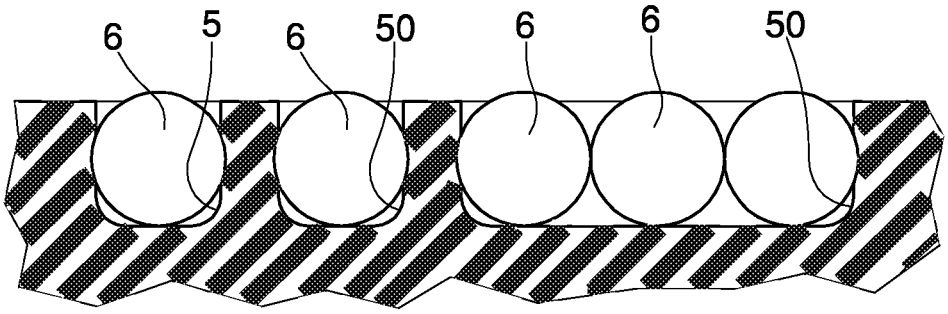
FIG. 5 shows, on the same scale as FIGS. 3 and 4, part of a cross section taken along a plane normal to the work surface of the lining and relating to a further embodiment.

There is also provided the use of cavities shaped so as to house not only a number of grinding bodies, but also a number of grinding bodies differing in shape and size (see FIG. 5).

The option of utilizing grinding bodies that are not particularly regular in terms of size is also provided.

Once the internal lining of the mill has been completed with the base 3, insertion of the hard inserts, constituted by part of the grinding balls or bodies 6, in the same lining, may be carried out in a first step in which the mill is started and rotated, with the sole charge of grinding balls or bodies 6.

Owing to the action exerted on the lining 2, the latter tend to enter the cavities 5 and insertion takes place.

During the actual milling step, the insertion remains active and subject to continuous regeneration.

The invention claimed is:

1. A ball mill comprising a wear-resistant lining and a charge of grinding bodies or balls (6) having a non-worn state and, after use, a smaller worn state, the wear-resistant lining comprising a base (3) made of a material that is elastically deformable at a work surface (4), said material being rubber or other synthetic material having similar elastic deformability, the wear-resistant lining having a plurality of cavities or hollows (5) each of which is structurally shaped and dimensioned in relation to the structural shape and structural size of the grinding bodies or balls (6) such that the structure of the cavities or hollows (5) effectively correspond to the structure of the grinding bodies or balls (6) such that (A) when the ball mill is started and rotated and contains solely the charge of grinding bodies or balls (6), a portion of the grinding bodies or balls (6) in the non-worn state find themselves effectively inserted into and stably housed in said cavities or hollows (5), and (B) after the ball mill is operated thereafter, the grinding bodies or balls (6) which are stably housed in the cavities or hollows (5) become worn into the smaller worn state and come out of the cavities or hollows (5) and are thereafter replaced in the cavities or hollows (5) by other grinding bodies or balls (6) having the non-worn state.

2. The ball mill according to claim 1 wherein a plurality of said grinding bodies or balls (6) are stably housed in said cavities or hollows (5) and wherein at least a portion of each grinding body or ball (6) stably housed in the respective cavity or hollow (5) protrudes externally at least in part from said work surface (4).

3. The ball mill according to claim 1, wherein the cavities or hollows (5) are shaped and dimensioned in relation to the shape and size of the grinding bodies or balls (6) so that when insertion and coupling are completed, at least a portion of each of said grinding bodies or balls (6) is situated at the same level as the work surface (4) so as not to protrude therefrom.

4. The ball mill according to claim 1, characterized in that the cavities or hollows (5) are shaped and dimensioned in relation to the shape and size of the grinding bodies or balls (6), so that when insertion and coupling are completed, the tops of the grinding bodies or balls (6) are situated below the level established by the work surface (4).

5. The ball mill according to claim 1, characterized in that each of said cavities or hollows (5) appears in the form of a cavity defined by the spherical surface portion of a spherical segment whose depth is not less than the radius of the corresponding sphere.

6. The ball mill according to claim 5, wherein said depth is slightly greater than the radius of the corresponding sphere.

7. The ball mill according to claim 5, characterized in that, in the initial, non-worn state, said grinding bodies or balls (6) have mutually equal diameters.

8. The ball mill according to claim 7, characterized in that, in the initial, non-worn state, said grinding bodies or balls (6) have diameters which enable a coupling by interference of a grinding body or ball (6) in a cavity or hollow (5).

9. The ball mill according to claim 1, characterized in that each of said cavities or hollows (5) is in the form of a cylindrical cavity or hollow (50) delimited by a lateral cylindrical surface with an axis perpendicular to the work surface (4) and a diameter such as to enable a coupling by interference with one of said grinding bodies or balls (6) in the initial, non-worn state.

10. The ball mill according to claim 9, characterized in that each of said cylindrical cavities or hollows (50) has a depth that is not less than the diameter of one of said grinding bodies or balls (6) in the initial, non-worn state.

11. The ball mill according to claim 1, characterized in that the base (3) has cavities of different shapes and sizes, suitable for accommodating grinding bodies of different shapes and sizes.

12. The ball mill according to claim 1, characterized in that the base (3) has cavities of different shapes and sizes, each suitable for accommodating a number of grinding bodies packed tightly side by side.

13. The ball mill according to claim 1, characterized in that the base (3) has cavities of different shapes and sizes, each suitable for accommodating a number of grinding bodies packed tightly side by side; said grinding bodies having different shapes and sizes.

14. The ball mill according to claim 1, wherein a plurality of said grinding bodies or balls (6) are stably housed in said cavities or hollows (5).

15. The ball mill according to claim 14, wherein the ball mill contains a plurality of grinding bodies or balls (6) in the smaller worn state, located in the ball mill but not stably housed in the cavities or hollows (5).

* * * * *